US006588877B2

(12) United States Patent
Sloan, Jr. et al.

(10) Patent No.: US 6,588,877 B2
(45) Date of Patent: Jul. 8, 2003

(54) METHOD AND SYSTEM FOR PRINTING SPECIFIC PRINT ZONES USING A BUNDLED PRINT HEAD SHUTTLE ASSEMBLY

(75) Inventors: Richard A. Sloan, Jr., Southbury, CT (US); Paul R. Sette, Branford, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/683,034

(22) Filed: Nov. 9, 2001

(65) Prior Publication Data

US 2003/0090536 A1 May 15, 2003

(51) Int. Cl.[7] ..... B41J 2/15
(52) U.S. Cl. ..... 347/40; 347/12

(58) Field of Search ..... 347/43, 15, 40, 347/12, 29, 33, 19, 14

(56) References Cited

U.S. PATENT DOCUMENTS 6,260,947 B1 * 7/2001 Pinkernell ..... 347/15
6,302,520 B1 * 10/2001 Akiyama et al. ..... 347/15

* cited by examiner

*Primary Examiner*—Lamson Nguyen
(74) *Attorney, Agent, or Firm*—George M. Macdonald; Angelo N. Chaclas; Charles R. Malandra

(57) ABSTRACT

A method and system for printing specific print zones of a substrate is described. A bundled shuttle print head assembly is utilized to print desired print zones of a substrate in a single pass while the substrate is stationary in a stopped position.

15 Claims, 3 Drawing Sheets

METHOD AND SYSTEM FOR PRINTING SPECIFIC PRINT ZONES USING A BUNDLED PRINT HEAD SHUTTLE ASSEMBLY

BACKGROUND OF INVENTION

The embodiments described herein may be useful in inkjet printing and more specifically to systems and methods for printing specific print zones of an envelope.

Certain printers that have print head assemblies, including certain thermal inkjet printers, utilize a shuttle head printing mechanism to enable coverage of the printable area of a page in bands of coverage. For example, a print head carriage may contain one or more print heads having a certain coverage height and width in a single row. Additional cartridges in the row may provide additional colors such as in a CMYK system having a separate head for each color. A single print head may be configured with multiple colors. The carriage may be connected to a guide rail to fix two axes and a positioning mechanism to control movement in an axis perpendicular to a substrate path. The positioning mechanisms that are used include an electric motor connected to an endless belt. Such a printer will paint the entire page by alternatively moving the page and print head over and over in bands of coverage that may include multiple passes in each band. Such a system may allow flexibility in coverage, but may be inherently slow relative to other systems because of oscillating and intermittent head movement. Such a system may paint across the page in one direction only and return the carriage for another pass without printing on the return path. More complicated printing systems may utilize bidirectional printing for increased throughput. Similarly, they may print landscape images using many page and print head movements.

In such shuttle head printers, page movement inaccuracies may cause knit lines (gaps or overlaps) in the printing bands. For inkjet print heads, a shuttle head mechanism may simplify the task of keeping the heads functioning properly by allowing print head "maintenance" by using a portion of the shuttle movement for maintenance tasks including wiping and parking the print head. Certain dedicated envelope printers print envelopes in bands using a shuttle head system.

Certain other printers that have print head assemblies, including certain thermal inkjet printers, utilize a fixed head printing mechanism to enable coverage of the desired print zones. In such a printer, a print head for each zone has been utilized and such printers typically print with pages running lengthwise beneath the print heads. The print heads are typically arranged in staggered mounting assemblies with a mounting assembly for each print zone equivalent to the coverage width of an individual print head. Such a printer may obtain relatively high throughput because there are less oscillating or intermittent movements of the print heads or page. Such fixed head printers utilize unidirectional printing such that all print head characteristics such as drop flight are in the same direction on each printed page. Such a printer would require a large number of print heads and print head mounting assemblies to cover a relatively large portion of a page. In such a system, knit line tolerances are limited to the mechanical tolerances of the print head mounting assemblies. Maintenance may be particularly difficult to accomplish in such print head assemblies as they typically do not move or are moved manually.

SUMMARY OF INVENTION

In one embodiment, a printer having a bundle of at least two print heads that are configured to provide greater coverage that a single head includes a shuttle mechanism for passing the bundled heads over a stopped substrate to cover print zones on the substrate in a single pass. In another embodiment, a method of printing two consecutive substrates involves moving the bundle from a maintenance position across the first substrate to print the print zones in one pass in that direction until reaching an end position, and when the second substrate is in place, returning across the path to print the print zones of the second substrate in the second direction in one pass. In another embodiment, the bundle returns to the maintenance station position while the maintenance station moves a wiper across the heads and then positions a cap to cap the heads of the bundle.

DETAILED DESCRIPTION

The present application describes embodiments of a system and method for printing at least one print zone of a substrate or media. The embodiments are illustrative and where alternative elements are described, they are understood to fully describe alternative embodiments without repeating common elements. The processes described provide useful results including but not limited to increasing print accuracy, optimizing printer throughput and simplifying maintenance. The embodiments discussed herein apply to an envelope printing system for illustrative purposes.

In-line printers that accommodate adjusting print zones based upon the width of the substrate are known as described in U.S. Pat. No. 6,293,650B1 and assigned to the assignee of this application and incorporated herein by reference.

Shuttle print head envelope printers such as the W650 and W790 are available from Pitney Bowes of Stamford, Conn. In-line print head envelope printers such as the W890 are available from Pitney Bowes of Stamford, Conn. Additionally, multi-purpose document handling equipment incorporating a printer may be utilized such as the DOCU-MATCH® system available from Pitney Bowes Inc. of Stamford, Conn.

Many print heads may be utilized including thermal inkjet heads such as the one-half inch print area heads including the HP51645A print head available from Hewlett Packard, the one-sixth inch print area HP51626A print head available from Hewlett Packard or other print heads including those with seven-eighths inch and one-inch print areas respectively. Inkjet print heads using other technologies may be incorporated. Similarly, other print head technologies may be utilized.

The embodiments described herein utilize a substrate feeding system that is preferably configured to feed standard #10 envelopes in a face up orientation with the bottom major edge fed first into the feed path. Such envelopes are 4⅛" on the minor edge and 9½" on the major edge. Other substrates and other sizes of paper and envelopes may be processed, but the #10 envelope is used for illustrative purposes. Print zones are typically defined in envelope applications by postal agencies. As can be appreciated, a single set of print zones may accommodate multiple size substrates such as #9, #10 and #11 envelopes.

Print head/carriage positioning, printing and computer interface controller systems and methods are known and not described in detail in this application.

Figure 1:
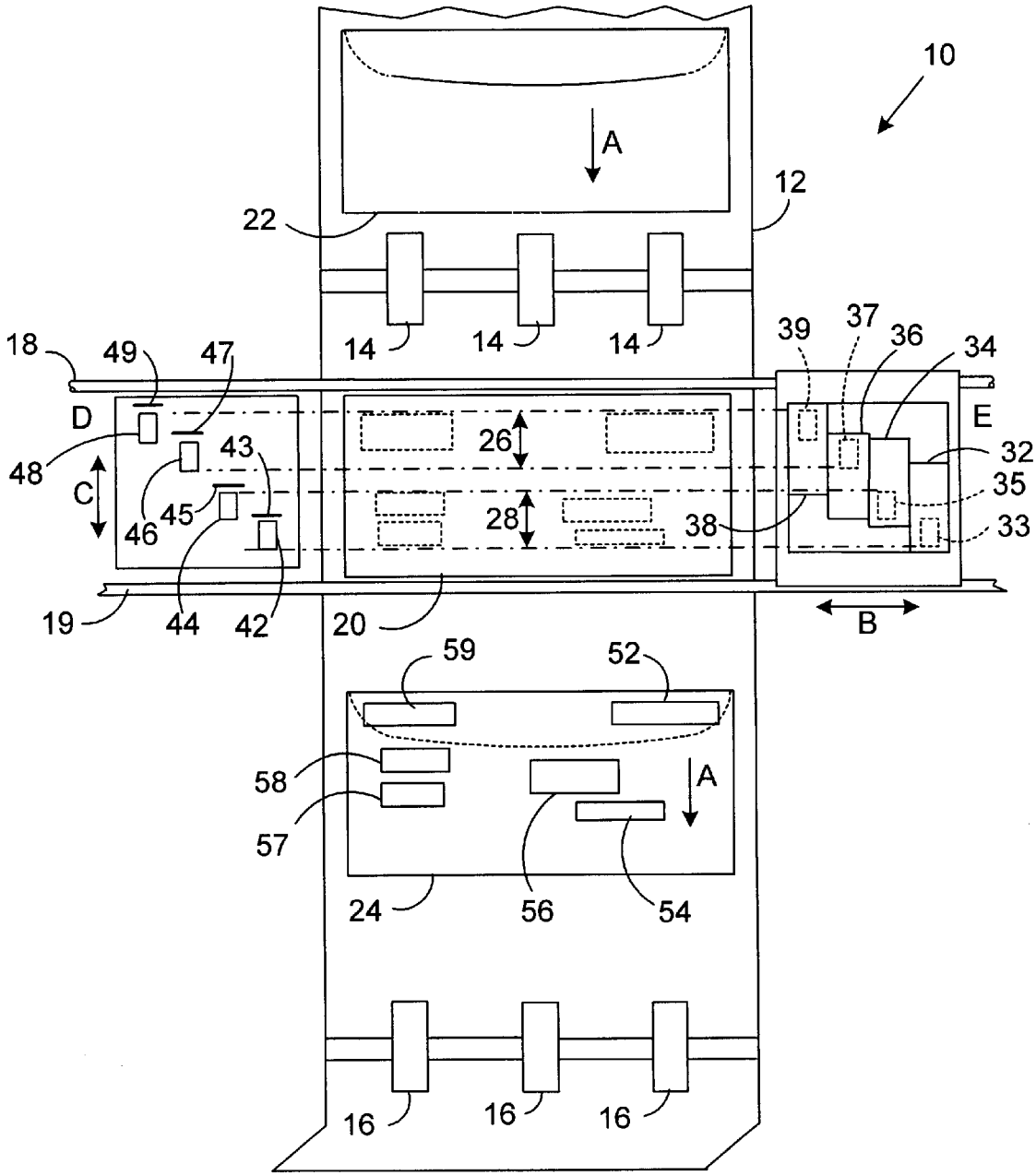
FIG. 1 is a diagrammatic representation illustrating a bundled shuttle print head printer according to an embodiment of the present application.

Referring to FIG. 1, a first embodiment is described. A bundled shuttle print head printing system 10 includes a feed path in the direction A. Substrate feeding and transport systems are known and not described herein in detail. A standard #10 envelope printer is described for illustrative purposes. A feeder such as a stack feeder feeds envelope 22 onto the envelope transport 12. In this embodiment rollers 14, 16 move a belt (not shown) on transport deck 12 to feed the envelopes in direction A. The belt is driven by an electric motor (not shown). The envelope 22 is a number 10 envelope for illustrative purposes that is defined as 9 and one quarter inch wide and four and one eighth inch high. The system includes at least one sensor to determine substrate location in order to indicate when a substrate has reached a stop print position. Alternatively, a top edge registration system may be utilized.

A set of bundled print heads 32, 34, 36, 38 is installed in a bundled shuttle print head carriage 30. The print heads are thermal inkjet print heads, but other print head types may be used. The carriage 30 runs on a support structure 18, 19 and is driven by a carriage positioning system (not shown) that includes an electric motor and an endless belt drive. The substrate transport system and carriage transport system is configured to allow printing when the substrate is in the proper position. Alternatively, the drives may be synchronized physically or by electrical signal feedback. Alternatively, the carriage may be driven by a screw drive.

The system includes sensors (not shown) to sense carriage speed and position. The substrate positioning system transports an envelope to the stop print position as shown by envelope 20. The envelope 20 is stopped during printing. When the envelope 20 is in the stop print position, the bundled shuttle print head carriage 30 leaves its maintenance position D and commences an outbound print run on path B toward position E. The print heads are controlled to print the desired graphics or text in the desired print zones 26, 28 or bands created by the path of the bundled shuttle print head carriage. Print head controller systems are known and commonly available printer drivers may be emulated. As the printing is one pass per page, there is a rest position at either side of the carriage path. In this embodiment there is a single maintenance station at position D and the carriage 30 will return to that position if there is a delay before printing the next envelope. Alternatively, there could be a maintenance station at position E as well.

In the current embodiment, carriage 30 has four print heads each with one half-inch print area heads bundled to create two separate one-inch print zones 26, 28. As shown in finished envelope 24, print zone 26 can print a return address field 59, and field 52 that may include a graphic, an indicia, a conventional or 2D bar code or permit mail designation. Additionally, the field 52 may include postage indicia. The fields listed are optional and other fields may be printed in print zone 26. Print zone 28 is utilized to print a graphic field 58, a message line 57, a destination address 56 and a postal bar code 54. The fields are optional and other fields may be printed in print zone 26.

Maintenance station 40 includes a wiper 49, 47, 45,43 for each corresponding head and a cap 48, 46, 44, 42 to park each corresponding head on. Additionally, there can be purge facilities (not shown). Accordingly, when the bundled shuttle print head carriage 30 is in position D, the maintenance head can move in the C path to wipe the heads and then move vertically to securely cap the print heads 38, 36, 34, 32.

The finished envelope 24 is then ejected or fed to another handler such as an inserter station.

Such a system allows minimal oscillating/intermittent movements, uni-directional printing and minimum knit lines, but allows printing across the page without bidirectional printing and paper movement complications while maintaining shuttle carriage maintenance options.

Uni-directional printing per page allows for less critical encoding and head movement tolerances allowing higher print quality. There is greater quality printing and for the maintenance station there is one stop/start of the page and one acceleration/deceleration of the print head carriage. Such a system may last longer before failure than traditional systems due to using fewer dynamic movements per substrate printed. System firmware or other processes may compensate for print head characteristics such as drop flight in each of the directions.

Figure 2A:
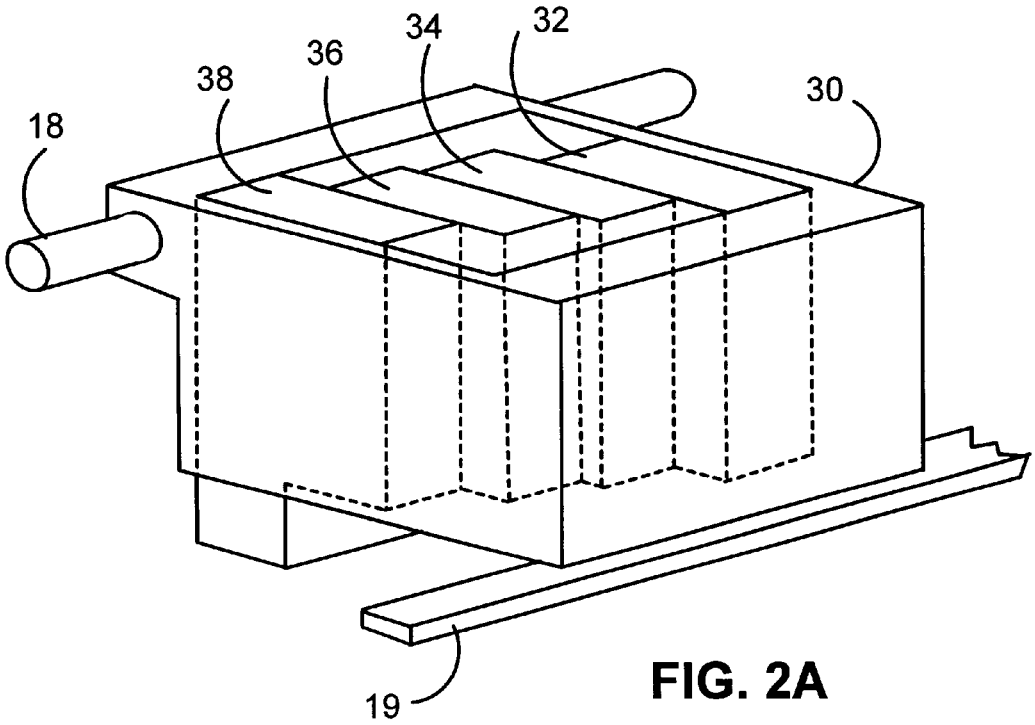
FIG. 2A is a perspective view of a bundled shuttle print head carriage assembly according to an embodiment of the present application.

Referring to FIG. 2A, a bundled shuttle print head carriage 30 is shown with a set of bundled print heads 32, 34, 36, 38 installed. The carriage 30 is guided by guide rail 18 and support 19. A carriage positioning system such as an electric motor connected to an endless belt drive (not shown) drives the carriage 30 in the paths shown by direction arrow B. Alternatively, a screw drive mechanism may be utilized.

Figure 2B:
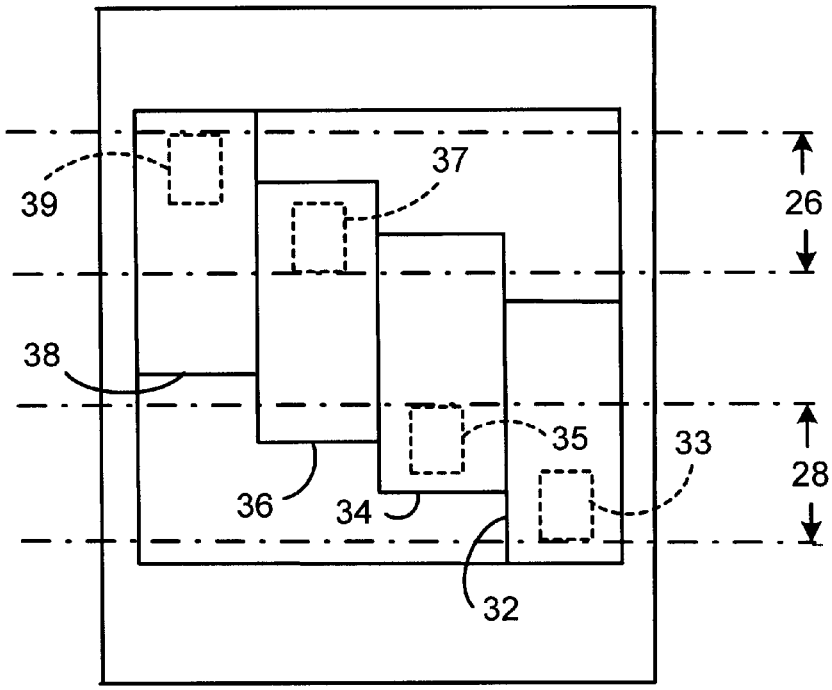
FIG. 2B a top view of a bundled shuttle print head carriage assembly according to an embodiment of the present application.

Referring to FIG. 2B, a bundled shuttle print head carriage 30 is shown with a set of bundled print heads 32, 34, 36, 38 installed. Bundled shuttle head assembly 30 includes print heads 38 and 36 with print areas 39 and 37 that are utilized to print in print zone 26. In this embodiment the print areas 39 and 37 of the respective print heads 38 and 36 are utilized to print in adjacent areas to provide a wider print zone. Bundled shuttle head assembly 30 also includes print heads 34 and 32 with print areas 35 and 33 that are utilized to print in print zone 28. In this embodiment the print areas 35 and 33 of the respective print heads 34 and 32 are utilized to print in adjacent areas to provide a wider print zone. The print heads are configured to spray down onto the substrate in this embodiment. The printer firmware could be configured to print horizontally if the substrate was transported on edge to the printer.

As can be appreciated, the printer may be required to modify the source image in firmware or otherwise to account for print heads being installed in differing orientations. Alternatively, the source program or printer driver could make such adjustments.

Figure 3:
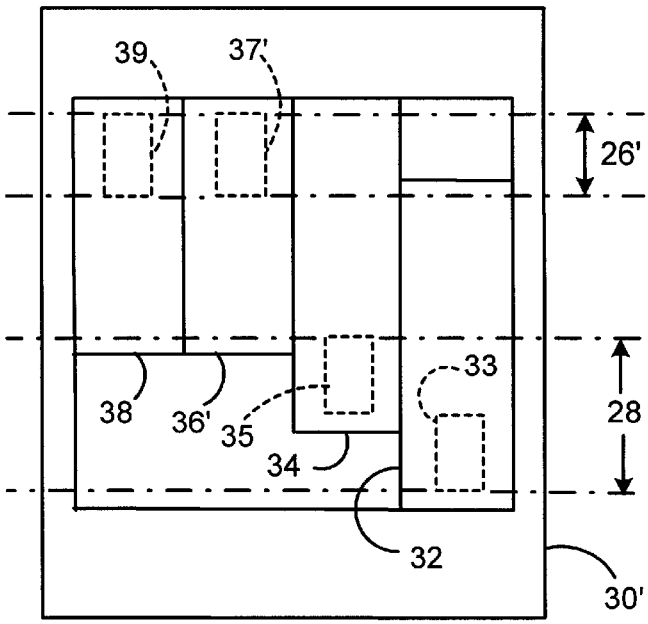
FIG. 3 is a perspective view of a bundled shuttle print head carriage assembly according to another embodiment of the present application.

Referring to FIG. 3, another embodiment of a bundled shuttle print head assembly is shown. Bundled shuttle head assembly 30' includes print heads 38 and 36' that are utilized to print in print zone 26'. In this embodiment the print areas 39 and 37' of the respective print heads 38 and 36' are utilized to print in the same area. Accordingly, the print heads may be utilized to print different colors or different types of ink such as fluorescent inks used for postage indicia. As can be appreciated, the width of the print zone 26' is limited to the width of the print head. As discussed above, the lower print zone 28 in this embodiment is twice the width of the print head print area. In this embodiment the print areas 35 and 35 of the respective print heads 34 and 32 are utilized to print adjacent areas in order to double the width of the print zone.

The print heads that comprise a single print zone may overlap if desired and the controller may be configured to account for such overlap.

As can be appreciated, printer firmware can be configured to modify a print zone such as by inverting it to account for print head groupings that are in differing orientations. Algorithms that minimize head movement to print images are known.

In an alternative embodiment, color ink heads may be ganged in a line that may or may not cover the entire print zone. The printer firmware could be configured to allow a one-half inch black print head to print adjacent to a set of three ganged sets of one-sixth inch CMY print heads. Printer firmware processes to split up images for printing and to minimize head movement are known.

The print zones may be controlled as separate areas of available bit map space or may be controlled a single combined print space such that the controller splits the required information and send the appropriate data to each print head.

Figure 4:
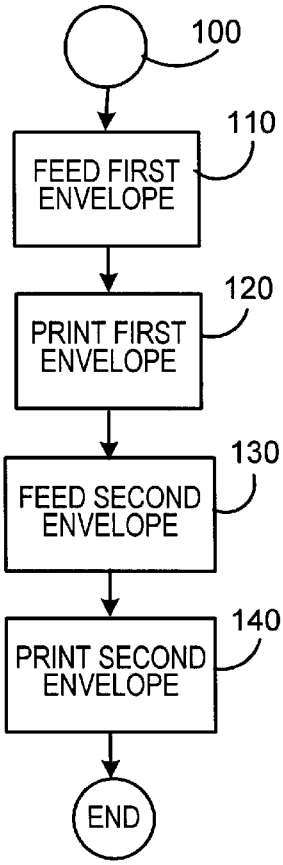
FIG. 4 is a flowchart of a print method according to another embodiment of the present application.

Referring to FIG. 4, a method for printing two substrates in sequence is provided. In this example, envelopes are used to illustrate a substrate. In step 100 the print process begins. In step 110, the first substrate is fed into the print stop position. In step 120, the bundled print head shuttle assembly leaves the maintenance station outbound to print the print zones of the first envelope. In step 130, the first envelope is ejected and the second envelope fed to the stop print position. In step 140, the bundled print head shuttle assembly returns on the inbound path to print the next envelope, thereby completing the printing process and returning to the maintenance station. The process ends and waits for another set of commands to print.

Alternatively, the print head carriage can be started before the substrate reaches the final stop print position.

Referring to FIG. 2B, in another embodiment in addition to that shown in FIG. 2B, the print heads are spaced in the carriage such that a one-inch print zone 26 is separated from the one-inch print zone 28 by a one-inch space. Accordingly, regardless of the size of the print zone utilized, the spacing between zones is the same width allowing even gap spacing on the cartridge. Accordingly, a page may be painted in alternate passes with a one-inch movement of the substrate.

Referring to FIG. 2B, in another embodiment in addition to that shown in FIG. 2B, an additional print head may be utilized for print zone 28 such that a one and one half inch print zone is obtained in order to accommodate larger destination address blocks and bar codes in a lower-right hand orientation.

As can be appreciated, a bottom right bar code may reduce throughput by up to half due to dimensional tolerances required. If a lower right hand corner bar code is required, the print zone associated with the bar code must be larger, or a third print zone would be required. In such a configuration, the third print zone may be obtained using a single print head. Additionally, to keep a uniform set of supplies, the third print zone may be configured to utilize only a portion of a single print head printing area.

In another embodiment, all of the print heads in the carriage are placed in the same orientation. As can be appreciated, the carriage will necessarily be larger to accommodate such an orientation and the maintenance station will also be larger. In such a configuration, the image for one of the print zones will not need to be modified because the print heads are in the same orientation.

In another embodiment, the maintenance station includes wipers for the heads that wipe in the direction of the carriage travel such that the maintenance station need only move in a vertical path to cap the heads. A spittoon may be incorporated in the center area of the cap or may be external to the cap.

In another embodiment, the print head carriage and the maintenance station are replaceable such that other size configurations may be utilized or so that worn parts may be replaced.

In another embodiment, incorporating two print stop positions accommodates a larger substrate. A large substrate such as a 10"×13" flat is fed into a first stop position. The bundled print head shuttle assembly leaves the maintenance station outbound to print a first set of print zones and arrives at an outbound stop position. The substrate is moved forward to the second stop position and the bundled print head shuttle assembly returns on the inbound path to print the next set of print zones, thereby completing the printing process and returning to the maintenance station.

In another embodiment, a heat based drying station tracks the bundled print head carriage to dry the most recently ejected substrate. Alternatively, a forced air-drying system may be employed.

The above specification describes a new system and method for printing specific print zones on a substrate that is useful and may increase throughput speed and/or accuracy of the system.

The described embodiments are illustrative and the above description may indicate to those skilled in the art additional ways in which the principles of this invention may be used without departing from the spirit of the invention. Accordingly the scope of the claims should not be limited by the particular embodiments described.

What is claimed is:

1. A method for printing a sequence of at least two substrates comprising:

receiving the first substrate;

transporting the first substrate to a print position;

printing at least two print zones on the first substrate by moving a bundled print head shuttle carriage having at least two print heads from a first position to a second position along a path for printing on the first substrate in the print position while printing the print zones of the first substrate;

receiving a second substrate;

then transporting the first substrate out of the print position;

transporting the second substrate to a second print position; and then printing at least two print zones on the second substrate by moving the bundled print head shuttle carriage from the second position to the first position along the path for printing on the second substrate in the second print position while printing the print zones of the second substrate.

2. The method of claim 1 further comprising:

maintaining the print heads by purging the heads; and maintaining the print heads by wiping the print heads and capping the print heads.

3. The method of claim 1 wherein the substrates comprise envelopes.

4. The method of claim 1 wherein the print position and the second print position are the same location.

5. A method for printing a sequence of at least two substrates comprising:

receiving the first substrate;

transporting the first substrate to a stop print position;

printing at least two print zones on the first substrate by moving a bundled print head shuttle carriage having at least two print heads from a first position to a second position while printing the print zones of the first substrate;

transporting the first substrate out of the stop print position;

receiving a second substrate;

transporting the second substrate to a second stop print position; and printing at least two print zones on the second substrate by moving the bundled print head shuttle carriage from the second position to the first position while printing the print zones of the second substrate;

maintaining the print heads by purging the heads at the first position and the second position; and maintaining the print heads by wiping the print heads and capping the print heads at the first position and the second position.

6. The method of claim 5 further comprising:

ejecting the first substrate.

7. A printer system comprising:

a substrate feeder;

a substrate transporter connected to the substrate feeder for positioning a first substrate in a print position;

a bundled shuttle print head carriage having at least two adjacent print heads;

a carriage positioning system for transporting the bundled shuttle print head carriage from a first position to a second position through a print path over the first substrate in the stop print position;

the substrate transporter connected to the substrate feeder for positioning a second substrate in the print position before the carriage positioning system is returned to the first position;

the carriage positioning system for transporting the bundled shuttle print head carriage from the second position to the first position through the print path over the second substrate in the stop print position; and a maintenance station positioned near the first position for contacting the carriage for maintaining the print heads.

8. The printer system of claim 7 wherein:

the maintenance station further comprises a wiper and a cap for each print head.

9. The printer system of claim 7 wherein:

the at least two adjacent print heads each have a print area that are configured such that the print areas are adjacent.

10. The printer system of claim 7 wherein:

the substrate transporter comprises a rubber belt driven by an electric motor.

11. The printer system of claim 7 wherein:

the substrate comprises an envelope.

12. The printer system of claim 7 wherein:

the print heads comprise one half inch wide print areas.

13. A print head assembly comprising:

a shuttle carriage;

a first group of print heads in the shuttle carriage having at least two adjacent print heads each with a print area configured to have the print areas adjacent to the print area of the adjacent print head; and a second group of print heads in the shuttle carriage having at least two adjacent print heads each with a print area configured to have the print areas adjacent to the print area of the adjacent print head, wherein at least two of the print heads are connected in the shuttle carriage in opposing directions.

14. The print head assembly of claim 13 wherein:

the first group and second group of print heads comprise thermal inkjet print heads.

15. The print head assembly of claim 13 wherein: the carriage is connected to a carriage positioning system.

* * * * *